United States Patent [19]

Bone

[11] Patent Number: 4,627,562

[45] Date of Patent: Dec. 9, 1986

[54] OPERATION OF TRIGGER ACTUATED DEVICES

[75] Inventor: Arnold R. Bone, Needham, Mass.

[73] Assignee: Dennison Manufacturing Company, Framingham, Mass.

[21] Appl. No.: 670,104

[22] Filed: Nov. 13, 1984

[51] Int. Cl.[4] ..... A43D 69/00

[52] U.S. Cl. ..... 227/67; 248/286; 269/69; 269/71

[58] Field of Search ..... 227/67; 248/286; 269/30, 190, 191, 192, 193, 194, 195, 196, 71, 69, 77

[56] References Cited

U.S. PATENT DOCUMENTS

| | | | |
|---|---|---|---|
| 632,381 | 9/1899 | Theadore | 269/71 |
| 638,737 | 12/1899 | Moran | 269/77 |
| 3,048,387 | 8/1962 | Waggoner | 269/69 X |
| 3,669,118 | 6/1972 | Colon-Morales | 248/286 X |
| 3,896,713 | 7/1975 | Mato | 227/67 X |
| 4,235,161 | 11/1980 | Kunreuther | 227/28 X |
| 4,237,779 | 12/1980 | Kunreuther | 227/30 X |

*Primary Examiner*—Paul A. Bell

*Attorney, Agent, or Firm*—George E. Kersey

[57] ABSTRACT

A bench mount for holding and operating trigger actuated devices. The mount aligns the device for convenient use. An air cylinder is attached to the mount and contains a piston and shaft. A connecting rod having a trigger intercepting bar at its distal end is coupled to the shaft to draw in the trigger when pressurized air is introduced to the cylinder. A pneumatic controller assembly is operable to reversibly interrupt air flow to the cylinder. A safety shield is attached to the mount to remain in protecting conformity with the aimed end of the device as the device is aligned.

6 Claims, 4 Drawing Figures

OPERATION OF TRIGGER ACTUATED DEVICES

BACKGROUND OF THE INVENTION

This invention relates to the operation of trigger actuated devices, particularly when bench mounted.

There are many varieties of trigger actuated devices. Examples are found in U.S. Pat. Nos. 4,416,407; 4,288,017; 3,893,612; 3,888,402; 3,759,435; and G.B. No. 1,474,242. These devices are used in attaching one-piece fasteners having bar-shaped ends. They are commonly employed in mass marking of saleable items with price tags.

There is the disadvantage that the user of such devices must operate a trigger repeatedly over a considerable period of time, resulting in fatigue.

An additional disadvantage is that the user must employ one hand in operating the device and the other for positioning the saleable item and tag. Considerable dexterity is required in order to apply tags quickly and safely. Moreover, time is wasted in alternately retrieving the tagging device and items.

Various attempts have been made to lessen the fatigue by devices utilizing fluid or pneumatic pressure, such as those shown in U.S. Pat. Nos. 3,659,769; 4,215,807; 3,880,339; 3,735,908; and 3,734,375. These facilitate the fastening of thick, difficult to pierce articles. However, pneumatic hand held devices, such as shown in U.S. Pat. Nos. 3,880,339 or 3,735,908, only partially relieve user fatigue in that the devices are relatively heavy as compared to mechanically actuated devices such as the fastener shown in U.S. Pat. No. 4,416,407.

In U.S. Pat. Nos. 4,215,807; 3,735,908; and 3,734,375 bench mounted versions of pressure utilizing assemblies are shown. Bench mounts offer the advantages of enabling an operator to use both hands in positioning tags and items, as well as fatigue reducing power activation. A disadvantage is that they require replacement of current mechanical hand held fastening devices of which many thousands are in use.

U.S. Pat. No. 3,896,713 discloses a mount for a trigger actuated fastener device. Carriage means raise and lower the vertically disposed device over a supporting surface, so that the mount provides the force for piercing the articles to be tagged. Means for operating the trigger is also provided.

Another example of a device mount is found in U.S. Pat. No. 4,235,161. The device fits between two longitudinal bars with a transverse rod cross-mounted at the ends. Fluid cylinders are provided for moving and positioning a work surface and articles to be tagged beneath the vertically disposed fastener device.

These mounts suffer from the disadvantage of being expensive to manufacture; this factor causes the equipment to be unavailable to a great many potential users.

Additionally, they must be adjusted for varying applications. Complicated conveying means are employed to promote the entry of the fastener needle at the proper location on the article. This is in part due to the fact that the point of entry of the needle cannot easily be determined due to the vertically fixed disposition of the device.

It is therefore an object of the present invention to relieve user fatigue and problems of manipulation attendant with mechanical hand held fastener devices without requiring the replacement of these devices.

It is an additional object of the invention to provide a mount which is simple in construction and inexpensive to manufacture.

Still another object of the invention is to provide a mount which is easy to use and which does not require complicated adjustments between differing applications.

It is a further object of the invention to provide an apparatus which is operable to actuate a variety of mechanical hand held trigger actuated devices.

SUMMARY OF THE INVENTION

In accomplishing the foregoing and related objects, the invention provides for automatic triggering of a hand holdable device. A mount holds and positions the device using guide pins to position it between two plates. A trigger pulling assembly coupled to an air cylinder draws the trigger upon activation. The apparatus of the invention further includes a support, safety shield, and air supply controller.

In accordance with one aspect of the invention, a shaft is coupled to a piston disposed within a cylinder. An extension arm having a trigger intercepting bar is coupled to the shaft. As pressurized air is introduced to the cylinder, the piston within the cylinder moves, resulting in the trigger being drawn by the trigger intercepting bar via the couplings.

In accordance with another aspect of the invention, an air supply controller is provided to reversibly interrupt the flow of air into the cylinder. The controller is positioned so that the user may control air flow with the hand or foot. In applications where the device is a fastener dispenser, the switch may be positioned to facilitate hand operation and holding of the labels and items to be fastened.

In accordance with a further aspect of the invention, a support is provided having a base which may be firmly fastened to a work surface. A supporting shaft and extension arm hold the mount within convenient reach of the user.

In accordance with another aspect of the invention, the mount is rotatably attached to the support assembly to orient the device for convenient use. A safety shield is provided coupled to an extension bar, which is in turn connected to an attachment plate. Thru-bolts couple the mount to the attachment plate, passing through slots in the extension arm. In this manner, the safety shield is maintained in protecting conformity to the aimed end of the device as the mount is rotated.

In accordance with an additional aspect of the invention, the connecting arm, guide pins, and other mounting means may be easily interchanged to accommodate a variety of device shapes and sizes without impairing the operability of the invention.

BRIEF DESCRIPTION OF THE DRAWINGS

Other aspects of the invention will become apparent after considering several illustrative embodiments taken in conjunction with the drawings in which.

DETAILED DESCRIPTION

Figure 1:
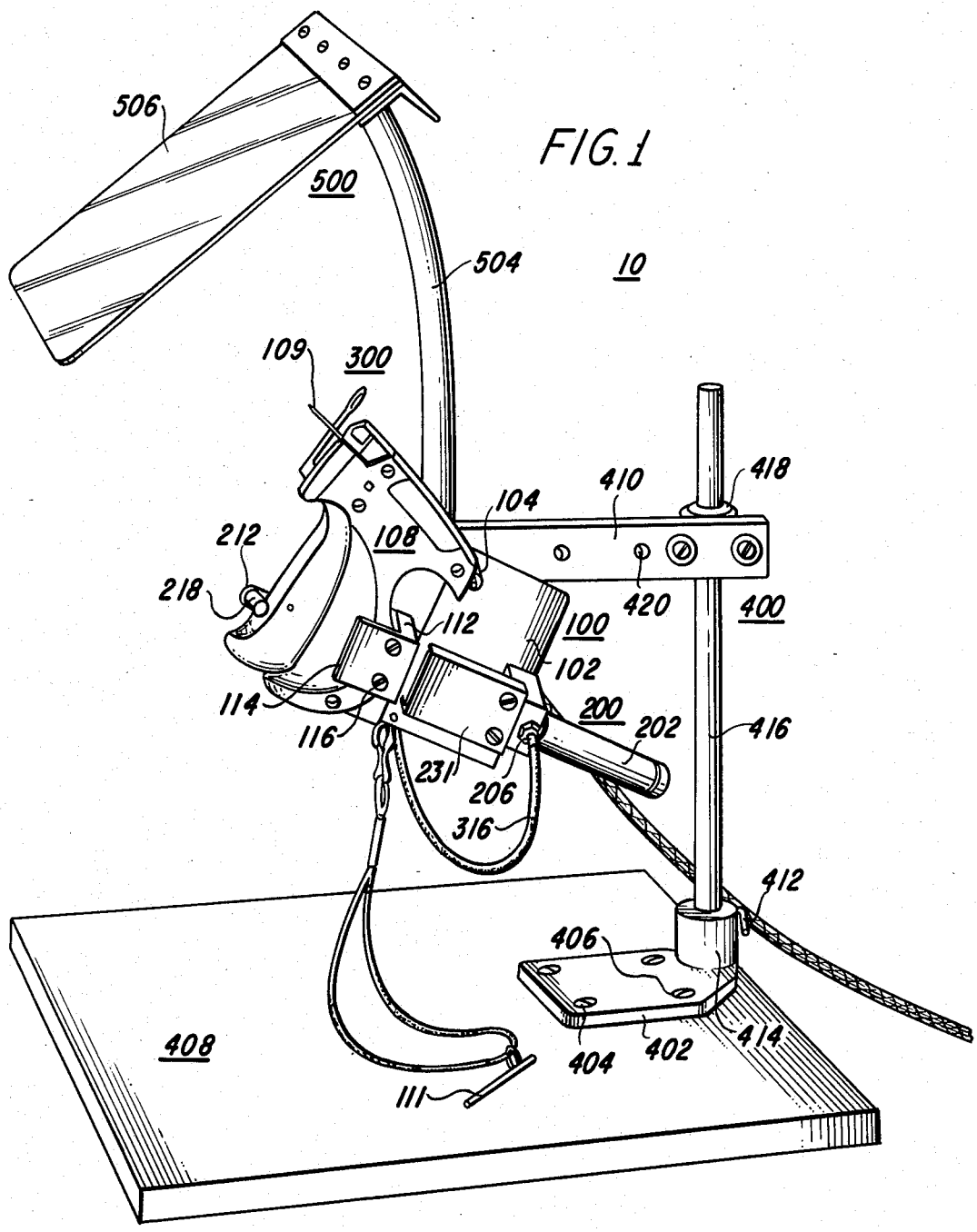
FIG. 1 is a perspective view of an apparatus for operating a trigger actuated device in accordance with a preferred embodiment of the invention.

With reference to the drawings, FIG. 1 depicts an apparatus for operating a trigger actuated device 10 of the present invention. A preferred embodiment, shown in FIG. 1, includes device mount 100, trigger pulling assembly 200, air supply controller 300, support 400, and safety shield assembly 500.

The mount includes a first side support plate 102 mounted to support extension arm 410 to accommodate two-dimensional rotation as will be explained further below. At least one, and in a preferred embodiment two, alignment pins 104 and 106 are attached to and extend perpendicularly from the first side support plate 102 to retain a trigger actuated device 108 in proper orientation against first side support 102. The device 108 is positioned behind a safety shield 506 with the aimed end facing the user. Where the device is a fastener dispenser, the needle would face the user in clear view for positioning of the tag and article. Guide pin 104 passes through a laniard retaining hole 110 disposed at the rear of trigger actuated device 108. Cross member 112 serves to prevent rearwards movement of trigger actuated device 108 during apparatus 10 operation, and additionally serves as an attachment point for a second side support plate 114. The second side support plate 114 may be removeably retained on cross member 112 by threaded fasteners 116, and lies in parallel conformity to the first side support plate 102. Trigger actuated device 108 is transversely retained between the first side support plate 102 and the second side support plate 114, and longitudinally retained by alignment pins 104, 106, and cross member 112.

Figure 3:
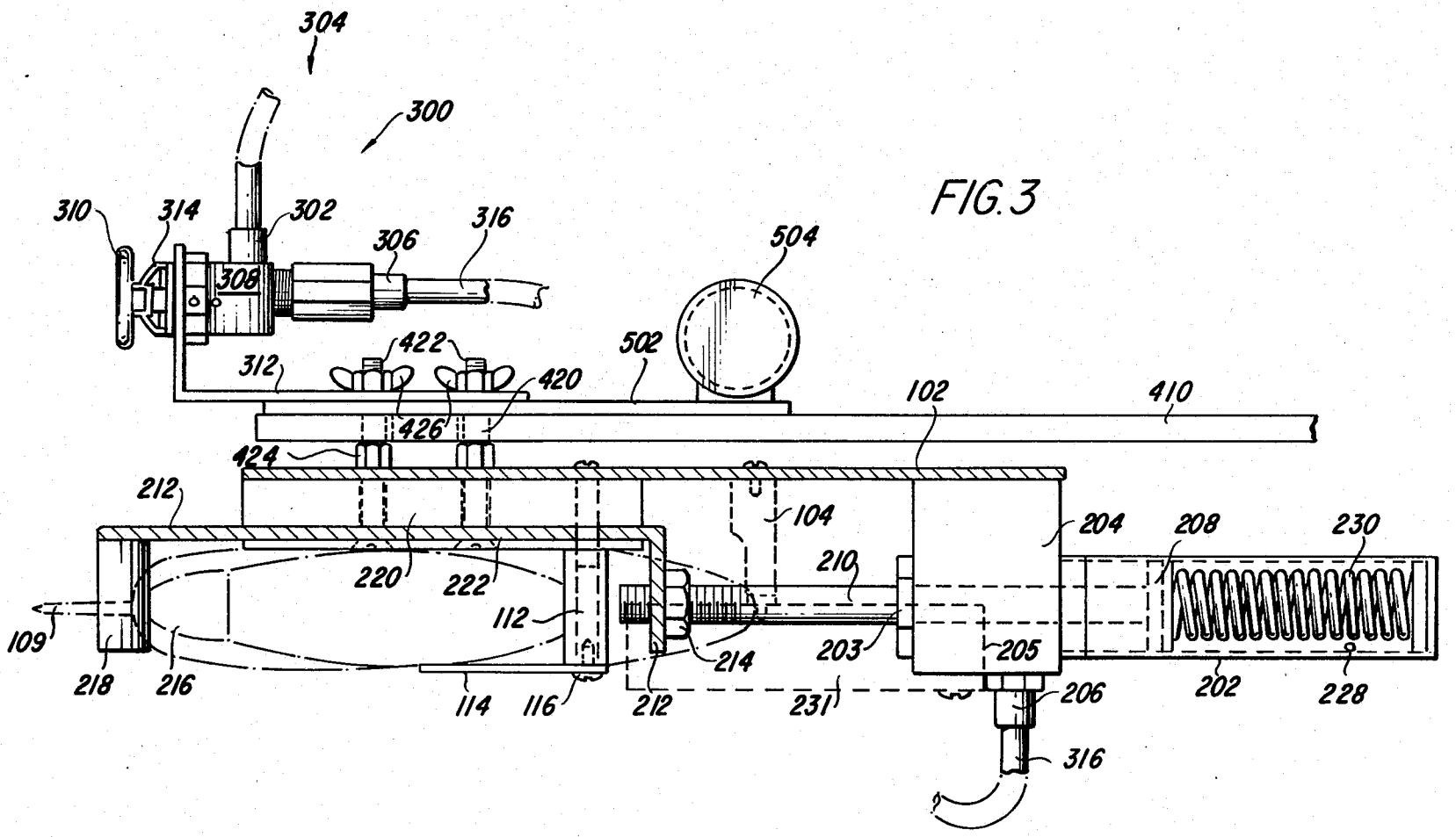
FIG. 3 is a partial sectional view of the trigger pulling assembly and mount in accordance with the invention with the device and protective cover removed.
Figure 4:
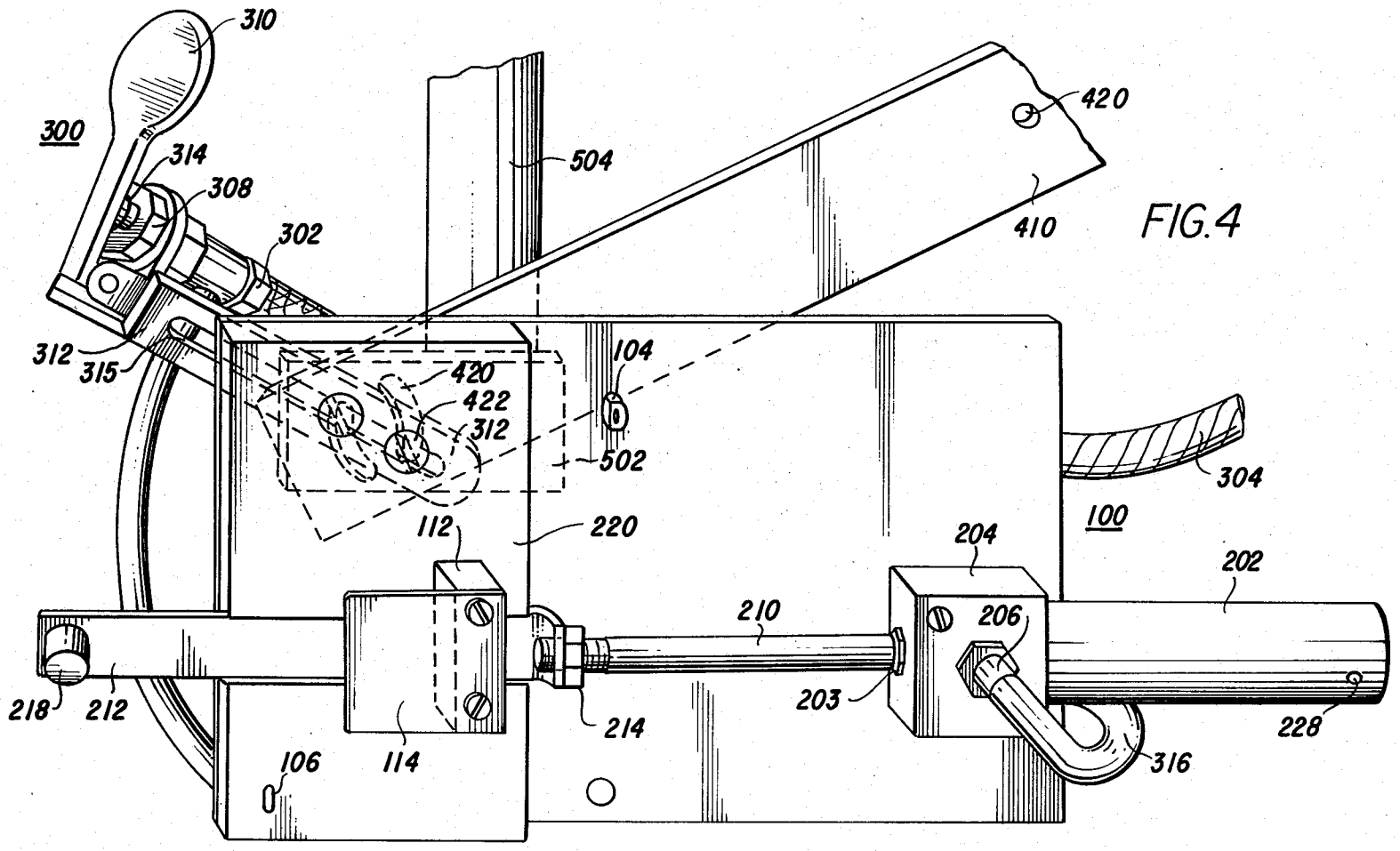
FIG. 4 is a partial sectional perspective view of the elements of FIG. 3.

Trigger pulling assembly 200 includes a cylinder 202 connected to mount 100 through attachment to connecting block 204. As shown in FIG. 3, cylinder input port 206 is provided in connecting block 204, in air passing communication with cylinder 202 through a channel 205 disposed within connecting block 204. A piston 208 is disposed within cylinder 202. A shaft 210 extends axially from piston 208 in communication with the exterior of cylinder 202 passing through a seal 203. A connecting arm 212 is fastened to the shaft 210 by internal threads and held firm by locking nut 214. Connecting arm 212 extends longitudinally along device 108 to a point beyond trigger 216. A trigger intercepting bar 218 is attached to connecting arm 212 at its distal end and extends perpendicularly from connecting arm 212. Connecting arm spacer 220 is provided with a channel 222 in which connecting arm 212 is slideably retained. Cross member 112 is disposed across channel 222 thus retaining connecting arm 212 within channel 222. Protecting cover 231 may be provided to prevent articles from contacting shaft 210 or connecting arm 212 during operation, and to keep shaft 210 clean and free of debris.

In a preferred embodiment, the trigger pulling assembly operates as follows. Pressurized air from air supply controller 300 enters connecting block 204 through cylinder input port 206, urging piston 208 inward with respect to said cylinder 202, causing shaft 210, connecting arm 212, intercepting bar 218, and trigger 216 to move inwardly with respect to device 108, resulting in actuation. When air pressure is interrupted by air supply controller 300, piston 208 is permitted to move outwardly with respect to cylinder 202 drawing air into venting aperture 228. Helical spring 230 may be disposed within cylinder 202 to urge piston 208 outwards with respect to cylinder 202 causing shaft 210, connecting arm 212, and trigger intercepting bar 218 to move outwardly with respect to device 108, thereby releasing trigger 216 causing deactuation.

Figure 2:
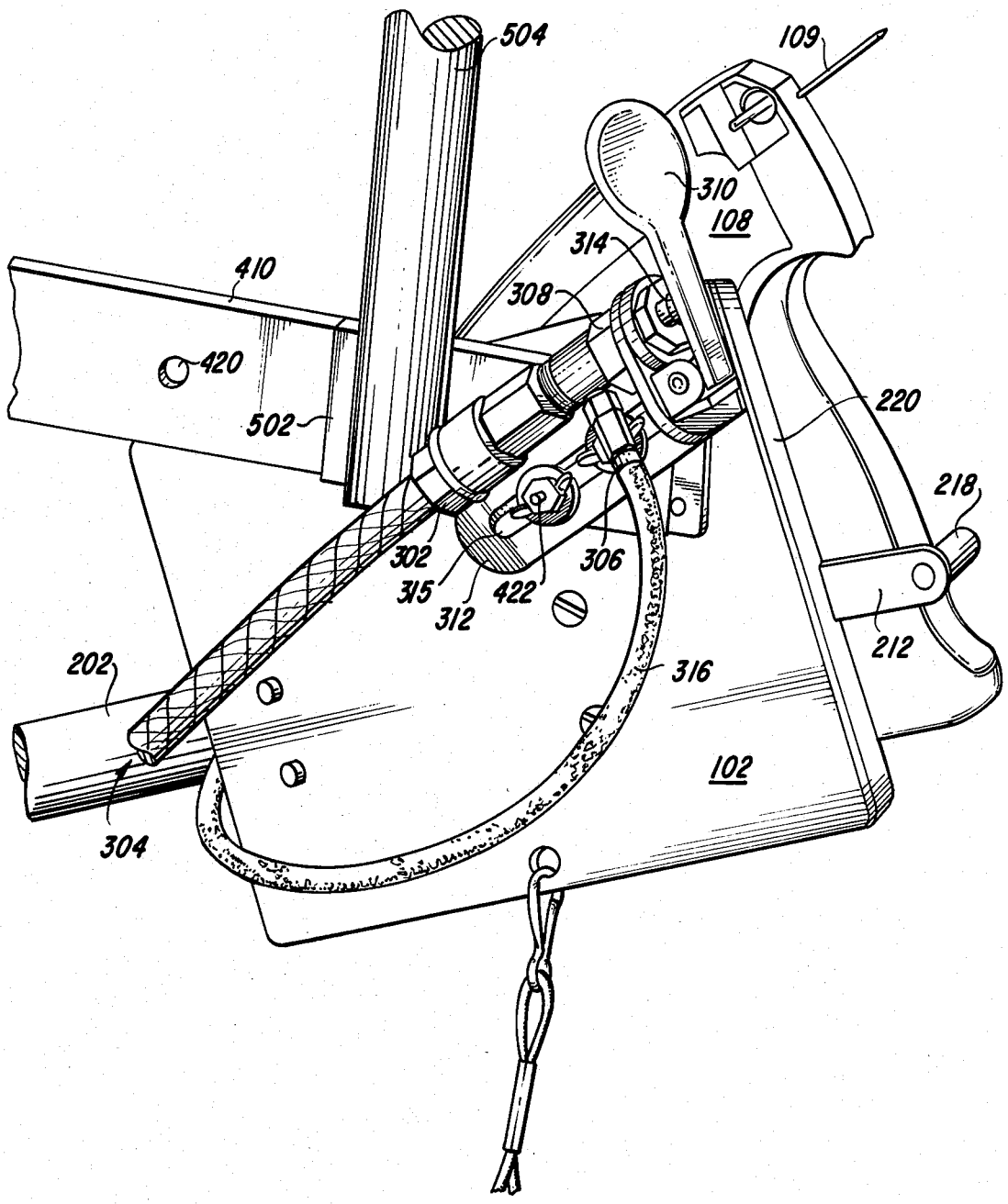
FIG. 2 is a perspective view of the device mount, air supply controller, and support extension arm.

With reference now to FIGS. 2 and 3, air supply controller 300 includes a controller input port 302 communicative with a source of high pressure air 304. Output controller port 306 is disposed in air passing communication to trigger pulling assembly 200 and valve 308. Lever 310 is hingedly connected to controller support 312 to reversibly depress valve stem 314. When lever 310 is pushed, air may pass from controller input port 302 to controller output port 306, then to trigger pulling assembly 200. Controller support 312 is slideably retained on support extension arm 410 by thrubolts 420 disposed within slot 315. In another embodiment, air supply controller 300 may be adapted for use by a user's foot, requiring air hose 316 to be long enough to reach from the floor to trigger pulling assembly 200.

Trigger actuated device 108 is maintained in an operational posture, facing the user, by mount 100 and support 400. Support 400 includes a base 402 provided with mounting holes 404 through which screws 406 may pass to threadably fasten base 402 to a work support surface 408. Support shaft 416 extends perpendicularly upwardly from base 402. Support shaft removal means 412 may be provided, including in a preferred embodiment, a set screw disposed within upright portion 414 of base 402. Extension arm 410 is slideably retained on and extends perpendicularly from support shaft 416. Extension arm retaining ring 418 is provided with the shape of a collar and may additionally be provided with a wing nut set screw to maintain extension arm 410 at a desired location along shaft 416. Extension arm 410 may be provided with additional holes 417 thus permitting support collar 418 to be mounted at various locations on extension arm 410. Extension arm 410 is provided with at least one curved slot 420 disposed about the distal end thereof. At least one elongated fastener 422 is provided connecting mount 100 and extension arm 410 through respective slots 420 and extension arm 410. In this manner, mount 100 may be axially rotated through a portion of an arc defined by slots 420 in a two-dimensional manner. In a typical embodiment, elongated fasteners 422 are threaded bolts.

As shown in FIG. 3, two bolts 422 pass through connecting arm extension 220; first side support plate 102; spacers 424; extension arm slots 420; safety shield attachment plate 502; air supply controller support 312; and are then fastened with a washer and wingnut 426.

As shown in FIG. 1, safety shield assembly 500 includes a safety shield attachment plate 502 rotatably mounted to attachment arm 410 through slots 420, in fixed relation to mount 100 by bolts 422. Extension bar 504 is attached to attachment plate 502 and extends upwardly and outwardly with respect to device 108. A transparent shield 506 is fastened to the distal end of extension bar 504. In this manner, transparent shield 506 is maintained in fixed protecting alignment to device 108 through cooperation with bolts 422 and mount 100. Most desirably, holes in attachment plate 502 are positioned to cause transparent shield 506 to lie between a user's body and the aimed end of device 108.

The device 10 of the present invention is therefore simple in construction and easy to operate. The user inserts the fastening device between plates 102 and 114, tightening screws 116. Nut 214 may be adjusted if necessary to place trigger intercepting bar 218 in snug conformity against trigger 216. A source of high pressure fluid is coupled to controller input port 302, such as a high pressure air line. The base is then mounted to an existing work surface with screws 406, or bolts if appropriate. The device is then ready for use.

To attach a tag, for example, a user slides the tag onto the needle 109. The tag will rest at the base of the needle so that both hands remain free to pick up and position the article. The article is then placed onto the needle. The hand trigger is activated by pressing the hand against lever 310 without the need for releasing the article. The device is operated by trigger pulling assembly 200, inserting the fastener through tag and article. As the tagged article is lifted off the needle, the trigger is released permitting the trigger to resume its deactivated position. When the apparatus is not in use, a needle sheath 111 may be placed on the needle for additional protection.

An additional device which the apparatus could operate includes a ballistics hand gun. Controlled testing of such devices could be carried out from a remote location without risk of harm to the investigator.

A cable tie fastener, such as is found in U.S. Pat. No. 4,192,358, may also be operated by the apparatus of the present invention. Objects to be cable-tied can be positioned at the end of the device mounted in apparatus 10. Lever 310 is held until the cable is tightened and cut.

It should be clear that other trigger actuated devices, originally designed to be hand held, could be operated by the present invention. Repositioning of alignment pins 104 and 106, and an adjustment of nut 214 on connecting arm 212 would typically be the only adjustments necessary to accommodate a differently shaped device.

While various aspects of the invention have been set forth by the drawings and the specification, it is to be understood that the foregoing detailed description is for illustration only and that various changes in parts, as well as the substitution of equivalent constituents for those shown and described, may be made without departing from the spirit and scope of the invention as set forth in the appended claims.

What is claimed is:

1. In combination: a hand-holdable fastener dispensing gun which includes a pivoted trigger, means for supporting and for pivoting said gun to a prescribed position to facilitate the operation thereof by an operator;

wherein said means for supporting and for pivoting said gun further comprises means for mounting and aligning said gun, a source of high pressure fluid, a trigger pulling assembly responsive to said source, means for cooperating with said trigger pulling assembly for controlling said source, and support means cooperating with said means for mounting and aligning to retain said gun in a nonvertical operational position;

and wherein said means for supporting and for pivoting said gun further comprises an attachment plate rotatably mounted to said support means, and in fixed relation to said means for mounting and aligning, and an extension bar attached to said attachment plate.

2. The combination of claim 1 wherein said means for mounting and aligning said gun includes:

a first side support plate rotatably mounted to said support means;

at least one alignment pin attached to and extending perpendicularly from said first side support plate;

a cross member attached to and extending perpendicularly from said first side support plate;

a second side support plate removably retained on said cross member to lie in parallel conformity to said first side support plate;

wherein said gun is transversely retained between said first and second side support plates and longitudinally retained by said at least one alignment pin and said cross member.

3. The combination of claim 1 wherein said trigger pulling assembly includes:

a cylinder attached to said mounting and aligning means;

a cylinder input port in air passing communication with said cylinder;

a piston disposed within said cylinder;

a shaft extending axially from said piston in communication with the exterior of said cylinder;

a connecting arm fastened to said shaft extending longitudinally along said gun to a point beyond the trigger of said device;

a trigger intercepting bar attached to and extending perpendicularly from said connecting arm;

wherein when air enters said input port said piston is urged inwardly with respect to said cylinder, causing said shaft, connecting arm, and intercepting bar to move inwardly with respect to said gun, drawing said trigger to actuate said gun.

4. The combination of claim 1 wherein said means for controlling said source of high pressure fluid includes:

a controller input port communicative with said source of high pressure air;

a controller output port communicative with said trigger pulling assembly;

a valve disposed between said controller input port and said controller output port;

a lever cooperative with said valve to reversibly interrupt air flow from said controller input port to said controller output port.

5. The combination of claim 1 wherein said support means includes:

a base having mounting holes;

a support shaft attached to and extending perpendicularly from said base;

an extension arm slideably retained on and extending perpendicularly from said support shaft, having at least one curved slot disposed about the distal end;

at least one elongated fastener connecting said means for mounting and aligning and said extension arm through respective ones of said at least one curved slot;

whereby said means for mounting and aligning may be axially rotated through a portion of an arc defined by said at least one slot; and said means for mounting and aligning are moveable upwards or downwards relative to said base by sliding extension arm along said support shaft.

6. The combination of claim 1 further comprising a transparent shield attached to said extension bar, whereby said transparent shield is maintained in fixed protective alignment between the aimed end of said gun and a user's body through cooperation with said means for mounting and aligning.

* * * * *